US008153051B2

(12) United States Patent
Vehof et al.

(10) Patent No.: US 8,153,051 B2
(45) Date of Patent: Apr. 10, 2012

(54) METHOD AND APPARATUS FOR HEATING STEEL COMPONENTS IN A CONTINUOUS FURNACE

(75) Inventors: Robert Vehof, Amersfoort (NL); Peter Buitenhuis, Nijkerk (NL); Alfons Heetjans, Cuijk (NL); Marcel Hartgers, Beuningen (NL); Toon Van Eck, Eoe (NL); Marcel Jaspers Focks, Amersfoort (NL)

(73) Assignee: voestalpine Automotive GmbH, Linz (AT)

( * ) Notice: Subject to any disclaimer, the term of this patent is extended or adjusted under 35 U.S.C. 154(b) by 723 days.

(21) Appl. No.: 12/085,629

(22) PCT Filed: Nov. 9, 2006

(86) PCT No.: PCT/EP2006/010754

§ 371 (c)(1),
(2), (4) Date: Dec. 22, 2008

(87) PCT Pub. No.: WO2007/062734

PCT Pub. Date: Jun. 7, 2007

(65) Prior Publication Data

US 2009/0127753 A1 May 21, 2009

(30) Foreign Application Priority Data

Dec. 2, 2005 (DE) ..... 10 2005 057 742

(51) Int. Cl.
*C21D 9/00* (2006.01)

(52) U.S. Cl. ..... 266/274; 266/249; 266/264

(58) Field of Classification Search ..... 266/44, 266/249, 264, 274; 148/656
See application file for complete search history.

(56) References Cited

U.S. PATENT DOCUMENTS

| | | | | |
|---|---|---|---|---|
| 2,006,612 | A | 7/1935 | Williams | |
| 3,830,479 | A * | 8/1974 | Knowles | 266/131 |
| 4,033,715 | A * | 7/1977 | Beck | 432/4 |
| 4,289,944 | A * | 9/1981 | Reese | 219/655 |
| 4,741,695 | A | 5/1988 | Ushijima | |
| 5,766,382 | A | 6/1998 | Hertzog et al. | |

FOREIGN PATENT DOCUMENTS

| | | |
|---|---|---|
| DE | 971 874 | 7/1949 |
| DE | 1 508 420 | 10/1966 |
| DE | 44 20 467 A1 | 12/1995 |
| FR | 2 534 676 A1 | 4/1984 |
| GB | 937079 | 9/1963 |
| GB | 2 332 503 A | 6/1999 |
| WO | WO 02/10465 A1 | 2/2002 |

OTHER PUBLICATIONS

Wuenning, J., "Die Wärmebehandlung in der Fertigungslinie mit einem neuartigen Rollenherdofen", HTM Harterei-Technische Mitteilungen, vol. 45, No. 6, (1990), pp. 325-329.

* cited by examiner

*Primary Examiner* — Scott Kastler

(57) ABSTRACT

The invention relates to a method and an apparatus for heating steel components in a continuous furnace, wherein a first transport device having an external drive receives the components in a precise position and transports them through the furnace in order to heat them, and a second transport device receives the parts, after the heating, from the first transport device at a predetermined transfer point or transfer region and conveys them out of the furnace at an increased speed and places them in a precise position at a further receiving point ready for further processing. The components are mounted on a support having engagement means for the different transport devices.

7 Claims, 4 Drawing Sheets

METHOD AND APPARATUS FOR HEATING STEEL COMPONENTS IN A CONTINUOUS FURNACE

FIELD OF THE INVENTION

The invention relates to a method for heating steel components, as well as a device therefor.

BACKGROUND OF THE INVENTION

It is known to heat steel components to the so-called austenizing temperature and to harden them thereafter by quenching. For heating to the austenizing temperature, so-called quenching furnaces are known, into which the components are placed and appropriately heated and thereafter removed.

Since the beginning of the nineties, not only machine components made of steel, such as shafts and bearings, for example, are being hardened, but also car body components. This process is also called press-hardening steel (PHS) process. In connection with this technology, a steel plate is heated to the austenizing temperature for obtaining car body parts with a high degree of strength, and is subsequently re-shaped and simultaneously rapidly cooled, so that the known hardening effect occurs. The strength of the car body material is increased by these hardening processes to as much as 1,500 MPa, for example. By means of this greatest possible strength of the material, it has become possible to clearly increase the safety of modern vehicles in case of accidents, while maintaining the same weight of the car body.

Up to now, continuous furnaces, but also roll-over-type furnaces, in which the panels or pre-shaped parts were heated, have been used for heating such steel plates. Because considerable oxidation (scaling) already occurs at the surface of these components at these temperatures, such hardening or heating furnaces are customarily operated with the use of a protective gas.

It is furthermore known to design panels or pre-shaped components with a coating of aluminum, or of an alloy consisting to approximately one-half of aluminum or zinc. With such coatings it is possible under certain circumstances to omit the protective gas atmosphere.

At present, continuous furnaces, such as roll-over-type furnaces, but also rotary tubular furnaces, in which the components remain for extended periods of time, are used for heating car body parts. The car body parts are thereafter transported to presses and are made into the desired shape there.

The existing furnaces have the disadvantage that the transport system is arranged in the interior of the furnace and is therefore highly prone to damage. Maintenance of the transport system can only take place when the furnace has cooled off. Added to this is that the positions of the car body parts are not fixed and that positional displacement of the components occurs in the course of the transport through the furnace, so that the components must first be repositioned when leaving the furnace, so that they can be removed thereafter and transported to the press. In this connection it is a disadvantage that the components which are not correctly and properly positioned, rapidly cool during the repositioning. To compensate these heat losses, the components are heated from the start in the furnace to temperatures which lie clearly above those which would be required for press hardening. The temperature required for press hardening lies customarily at 930° C.

Because all components are heated to a higher than necessary temperature, but only a part of the components needs to be repositioned, components reach the re-shaping tools at different temperatures. However, different temperatures also mean that the obtained hardnesses are not uniform and fluctuations exist here. This also means that the components of different initial temperatures possibly also have different end temperatures, so that deformations can also occur.

It is moreover disadvantageous in connection with customary furnaces that product carriers weighing more than 60 kg are employed. Following the heating of the car body parts, these carriers are run out of the furnace and are transported back to the entrance outside of the furnace, where then a new component can be placed on these carriers. In the course of being moved out, back and in again, the carrier loses up to 200° C. This heat loss must be compensated again in the furnace, i.e. the furnace must not only heat the car body components, but also the carriers in addition, which requires additional energy.

A further disadvantage in connection with known roller hearth furnaces is that roller hearth furnaces are limited in their width. Since the rollers are made of a ceramic material or heat-resistant steel, bending because of the influence of heat occurs at too large a width of the furnace, which cannot be tolerated in the present case. This furthermore leads to damages of the rollers because of shifting loads.

It is the object of the invention to create a method by means of which steel components, and in particular sheet steel components which are to be subjected to press-hardening, can be efficiently and cost-effectively heated, production quality is balanced, and energy is saved.

It is a further object to create a device for executing the method.

SUMMARY OF THE INVENTION

The method in accordance with the invention proposes to provide a first transport device in a hardening furnace, which transports the components absolutely correctly as to placement and positionally correct through the furnace.

The method in accordance with the invention furthermore provides to transfer the components to a second transport device at the furnace outlet, which takes over the components positionally correct from the first transport device and moves them at a high speed out of the furnace correctly as to placement and positionally correct and transfers them at a transfer station of a corresponding reception station for placement into a press, or into a shaping tool, for press hardening.

A third transport device is provided in a further advantageous embodiment which, in the area of the furnace inlet, introduces the components at a very high speed from the outside into the furnace and transfers them in the correct position to the first transport device, or receptacle of the first transport device.

The method further proposes that the second and/or the third transport device conducts the components to be hardened through respective furnace inlet and furnace outlet locks, which are only opened for the moment of the passage of the components, and are subsequently immediately closed. Because of the high speed of feed-in and removal from the furnace, the locks are only opened for a very short period of time, so that the energy loss is very small.

The method in accordance with the invention furthermore provides that the components to be hardened, for example panels or pre-shaped or already finally shaped components, are placed on carriers, which are specific for the respective components and are transported by means of the transport devices. However, only partial areas of the carriers are conducted in the actual furnace, the greater portions are conducted outside the furnace, wherein for the positionally-correct transport through the furnace appropriate corresponding reception means are provided, which can be engaged by the reception means of the first transport device, the second transport device and, if applicable, the third transport device. The engagement, or coupling, of the carriers with the transport devices takes place outside the furnace. Also the guidance of the carriers.

It is advantageous in connection with the method in accordance with the invention that, because of the possibly high feed-in and removal speeds regarding the furnace, and the positionally-correct transport of the components, the components lose less heat and therefore do not need to be heated as greatly as in the prior art. Because of the positionally-correct transport and the low heat loss, all components in the pressing process have approximately the same temperature, by means of which homogeneous material properties are obtained over the entire process.

Because only a small part of the carriers is heated, and locks are furthermore provided, it is possible to keep the heat which leaves the furnace in the form of lost heat low. Because of this the method can be performed optimized as to energy.

The device in accordance with the invention is a furnace, having a furnace chamber. At least one linearly extending slit is provided in the floor of the furnace chamber, and a transport space, or transport area, is arranged underneath the furnace base. At least one transport chain or a transport belt is arranged in the transport area underneath the furnace base, which is located underneath the slit in such a way that the upper portion of the chain moves along the slit, and the lower portion of the chain runs back.

In order to prevent heat from exiting the slit, in particular by convection and radiation, or the entry of air, the slit preferably has a seal. In the simplest case, the seal can consist of brush-like strips, which protrude into the slit from an edge delimiting the slit, having closely adjoining fibers made of a heat-resistant plastic, such as PTFE, and/or metal fibers, and/or glass fibers, and/or ceramic fibers. In a further advantageous embodiment, the slit is sealed from both faces delimiting the slit by means of Teflon® lips preferably having an overlapping area. It is moreover possible to provide a multitude of metal lamellas along the slit, which are pivoted parallel with the base wall of the furnace and perpendicularly in relation to the slit and are spring-loaded. The brush fibers, as well as the plastic lips, as well as the spring-loaded metal lamellas are pushed, or pivoted, aside by a support column of the moving carrier and, following the passage of the support column, again enter the area of the slit, so that a dependable barrier against heat and/or infiltrating air is achieved. The barrier can also be in the form of an air curtain.

The reversing star wheels, or deflection pulleys of the chain are arranged in the area of the beginning of a furnace or of a lock area. Spikes or protrusions are provided at regular spacing in the direction toward the furnace inlet, or the furnace outlet, on the chain. Linear drive mechanisms, which are aligned with the movement direction of the chain, are arranged in the area of the reversing star wheels, or deflection pulleys of the chain, or chains, in case several chains are arranged next to each other. The linear drive mechanisms each have a pick-up device which, in the same way as the chain, has a spike or protrusion. This spike, or protrusion, is also embodied to point toward the furnace base, or upward, but the spike or protrusion of the linear drive mechanism is designed to be extendible and retractable.

For example, the spike can be pneumatically or hydraulically actuated. Carriers are provided for transporting the components, which are designed in the manner of flat plates, for example. The flat plate-like carriers have at least one recess on their underside, which a spike of the linear drive mechanism and/or of the conveyor chain can engage. The carriers are laterally conducted in U-shaped profiles or appropriate sliding rails or similar, so that they are pushed along these sliding rails or U-shaped profiles by means of the spikes engaging their underside. These carriers extend through the slits of the furnace with a support arm upwardly extending away from the chain and from the plate, wherein a receiver for a component to be hardened is releasably arranged on a free end of the support arm projecting upward into the furnace. Depending on the shape of the component, the receiver for the component can be exchanged and has, for example, a flat contour, on which the component rests, however, for components into which a hole pattern has already been cut, it can merely have branched support arms, which engage the respective holes from below and in this way permit good heating of the component. The furnace, or the receiver, is preferably embodied in such a way that the component to be heated is at a minimum distance of 200 mm from all furnace walls. The base wall of the furnace is preferably designed to be thicker than the other walls for keeping heating losses from the slit because of radiation and convection small. With a wall thickness of the furnace of, for example, 200 mm, the base has a thickness of 300 mm.

On the underside the plate-like component of the carrier has for example three recesses, arranged one behind the other in the conveying direction, for the spikes, or protrusions. For introducing such a carrier into a corresponding furnace, the carrier is fully automatically placed on a first spike of a linear drive mechanism, which is intended to push the carrier into the furnace. The linear drive mechanism is controlled in such a way that, at a defined point in time, it pushes the carrier, or the plate, in the profiles, or slide rails, toward a furnace inlet lock, which consists in a manner known per se, of two gates arranged one behind the other.

When the carrier passes a defined area of the furnace, or furnace inlet, wherein this area is determined by means of sensors arranged in the slide rails, for example, the first furnace gate opens and, after this area has been passed, closes. The carrier is now conducted through the intermediate lock until it passes through a further area, which leads to the opening of the inner lock.

Then this lock is also opened and the linear drive mechanism pushes the carrier also through this area. Cold control here takes place in such a way that the carrier is positioned in the area of a first deflection star wheel, or deflection pulley of the conveyor chain, when a suitable spike or protrusion of the conveyor chain is conducted upward around the conveying star wheel.

Then this spike, or protrusion, engages the center recess, while during this time the linear drive mechanism has already lowered its protrusion and is moved back into its initial position and picks up the next carrier there and conveys it. The carrier is then conducted, laterally guided along the slide rails or U-shaped profiles, while it is pushed by the protrusion of the conveyor chain.

At the end of the conveyor chain the conveying protrusion of the conveying chain comes out of the recess in the carrier, while a spike engages the third recess, in front in the conveying direction, of the plate in a time-controlled manner and at the same time, if possible and, by means of the linear drive mechanism connected with it, pulls the carrier out of the furnace. In the process the carrier continues to be guided in U-shaped profiles or lateral guide rails, while a control of the furnace lock at the outlet of the furnace takes place in the same way as during the entrance.

It is of course possible to employ furnace locks with only a single door. The linear drive mechanisms at the front and end of the furnace are capable of greatly accelerating the carrier and the components resting on it and of moving it out of the furnace.

Because the carriers are conducted, correctly placed and positioned, in the U-shaped profiles or sliding rails, and furthermore the conveying spike or protrusion of the linear drive mechanism, or also of the conveyor chain, exactly determines the position during passage, the carrier and the components get out of the furnace positionally correct. As soon as the carrier and the components have come out of the furnace, the components can be removed and conducted into a press. The carriers are taken out of the corresponding guide rails and automatically returned above or below the furnace to the furnace entrance and placed again into the rails and conveyed by means of the linear drive mechanism.

In place of one conveyor chain it is also possible to employ two conveyor chains extending parallel with each other and having a synchronous drive mechanism. In this case it is advantageous if the respective linear drive mechanisms can move between the chains in order to transfer the carrier or to take it over. The engagement means, such as for example cams, run parallel to each other on respectively one of the chains, so that two engagement means are provided which act on both sides of a center area on the carrier, or of corresponding engagement means. With their engagement means, the linear drive mechanisms preferably engage a single engagement means in the transverse center area of the carrier between the engagement means for the chain cams.

Although with this device in accordance with the invention the carriers are also taken out of the furnace and again placed back into it at the entrance to the furnace, with the transport system in accordance with the invention only a fraction of the carrier is heated at all, so that the heat loss is considerably less than with the prior art.

The invention has been explained in connection with one conveyor chain, one slit and one single element resting on top. However, it is also possible to let two or several conveyor belts run parallel under the furnace and to provide a slit for each conveyor chain. By means of this it is possible to convey a correspondingly increased number of components through the furnace and to subsequently press them. On the other hand it is also possible to synchronize the conveyor chains and the linear drive mechanisms in regard to their movement and to place individual large components, for example, onto two or more carriers and to conduct them through the furnace.

Other conveying systems besides the described conveying system are of course also conceivable. Thus the conveyor chain underneath the carrier can also act on appropriate recesses in lateral areas of the carrier adjacent to the conveyor or sliding rails or U-shaped profiles. For this purpose the carrier has only one recess, for example in the linear center, for the two linear drive mechanisms. With this embodiment it is additionally also possible to use, instead of one chain with two protrusions, or spikes, arranged parallel and transversely to the conveying direction, two conveyor chains, whose movements are synchronized, so that the linear drive mechanism can convey into the area between the two deflection pulleys, or star wheels, in order to assure a dependable transfer.

Further than that, it is also possible that the plate-like components of the carriers have protrusions which extend laterally past the U-shaped profiles, which are engaged by the spikes, or protrusions, of the chain. For this purpose the guide rails in the lateral areas of the plate-like components are designed either as U-shaped profiles with an open bottom, or merely as an L-shaped support rail which, with an upwardly extending edge, assures the lateral guidance of the plates, but do not extend around the plates in an upward direction.

Further than that, it is also possible that the spikes of the conveyor chain, which move the plate-like components underneath the furnace, do not engage lateral protrusions from behind or engage the recesses on the underside, but merely rise behind the back of a rear transverse edge of the plate, act on the rear transverse edge, and in this way push the plate through the furnace. If for reasons of technical maintenance, reverse conveying of the plates should become necessary, this is also not a problem, because the spikes of the reversing chain then act on the front transverse edge.

Otherwise it is only essential for the device in accordance with the invention that the carriers are conveyed into the furnace by means of a linear drive mechanism at a relatively high speed in a positionally correct manner, are positionally correctly conveyed through the furnace by means of an appropriate transport device, and are conveyed out of the furnace at the end at a high speed and positionally correctly, and are positionally correctly arranged in a transfer station. Moreover, the entire transport device is arranged in a non-critical temperature range.

In addition, it is advantageous in connection with the invention for the transport system not to be arranged inside the furnace, but underneath its furnace base, and that only a small support, which receives the components, projects through a slit at the base, but the remainder of the carrier is conducted outside of the furnace.

The linear drive mechanisms can be customary spindle drives, pneumatic drives or hydraulic drives. A position and path control is decisive for the use of the invention. Therefore, in place of engagement means, the linear drive mechanisms can also have grippers at their ends, which grasp the carrier at one edge.

The spikes, or conveying protrusions, on the chains are arranged at distances of 200 mm, for example, however, any arbitrary spacing in the conveying direction, which is matched to the appropriate carries, is possible.

In accordance with the invention it is of course possible to employ toothed belts, V-belts or all other known types of belts, in place of chains.

In place of chain, belt or other driving means, which are guided at the upper or lower stringer, it is of course also conceivable to perform the conveying process in the area of the furnace base by means of a spindle drive, pneumatic or hydraulic drive.

It is of course also possible to use a single linear drive mechanism, which conveys at different speeds in the different areas of the furnace. This is possible in particular in connection with units, in which shapes are intended to be heated wherein either heating takes place particularly rapidly on account of inductive heating, or in connection with which it is not required to process a particularly large number of pieces, or which are very rapidly heated because of their small size.

Such rapid insertion and removal times of the carriers, or of the components, cannot be achieved in roller hearth furnaces of the prior art. It is impossible, on the one hand, to achieve rapid feeding with roller hearth furnaces, because the conveying rollers have a much too low frictional resistance for providing acceleration. It is furthermore not possible to realize different roller speeds in a roller-conveying device, because in this case the component would be displaced in an uncontrollable manner in those areas, in which the component is moved from faster rollers onto slower rollers. The same happens at the transfer point from slower to faster rollers. It should be pointed out again in principle, that a conveyance, which is actually accurate in regard to position and placement, is not possible in roller hearth furnaces. However, such conveyance, which is accurate in regard to position and placement, as in connection with the invention, is also required, because the component is customarily picked up from the second transport device by means of a robot. Here it is advantageous in connection with the invention that in a servo-controlled linear drive mechanism it is possible in a simple way to provide a control linkage between the linear drive mechanism, or the position of the component, and a robot, so that a "flying" removal is easily possible by means of the robot.

In contrast to roller hearth furnaces, which are limited in width, the furnace in accordance with the invention can have any arbitrary width. It is therefore possible to provide any arbitrary number of slits, and furthermore to provide access or manholes for entering the furnace from below.

The method in accordance with the invention, and the device in accordance with the invention, will be explained by way of an exemplary embodiment of the invention by means of the attached drawings.

DETAILED DESCRIPTION OF THE PREFERRED EMBODIMENTS

Figure 1:
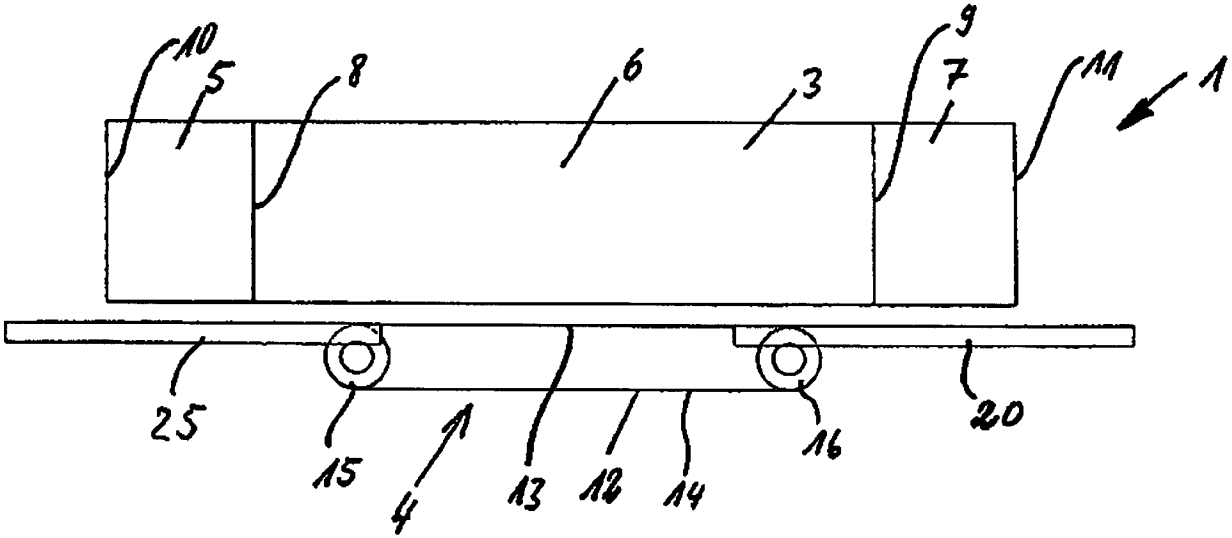
FIG. 1, the device in accordance with the invention, greatly schematized, in a lateral, partially sectional plan view.
Figure 2:
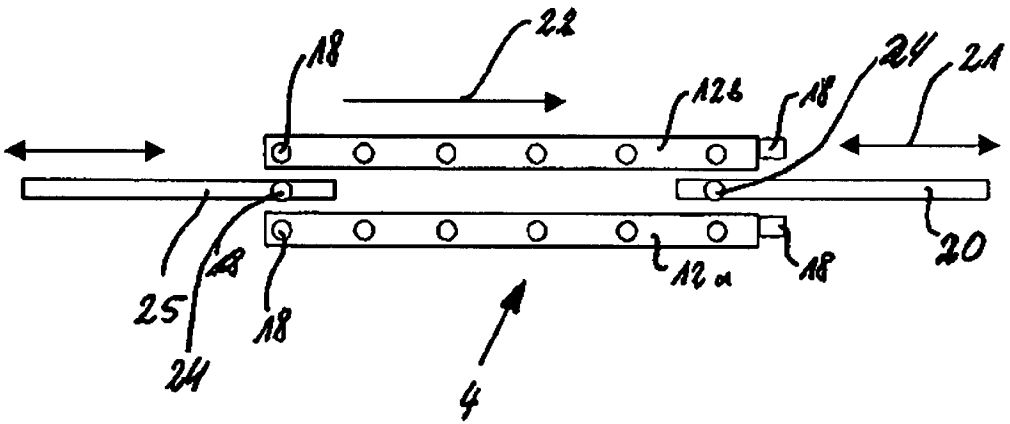
FIG. 2, the transport device in accordance with the invention, greatly schematized, in a view from above.

The device 1 in accordance with the invention for heating components 2 comprises a continuous furnace 3 with a transport device 4. The furnace 3 has a furnace inlet 5, a heating zone 6, as well as a furnace outlet 7. The furnace inlet 5 and the furnace outlet 7 are separated from the area 6 by respective lock doors 8, 9. In addition, the furnace inlet 5 and the furnace outlet 7 are separated from the atmosphere by respective furnace gates 10, 11.

It is alternatively possible for only the furnace gates 10, 11, or the lock doors 8, 9 to be provided.

Figure 3:
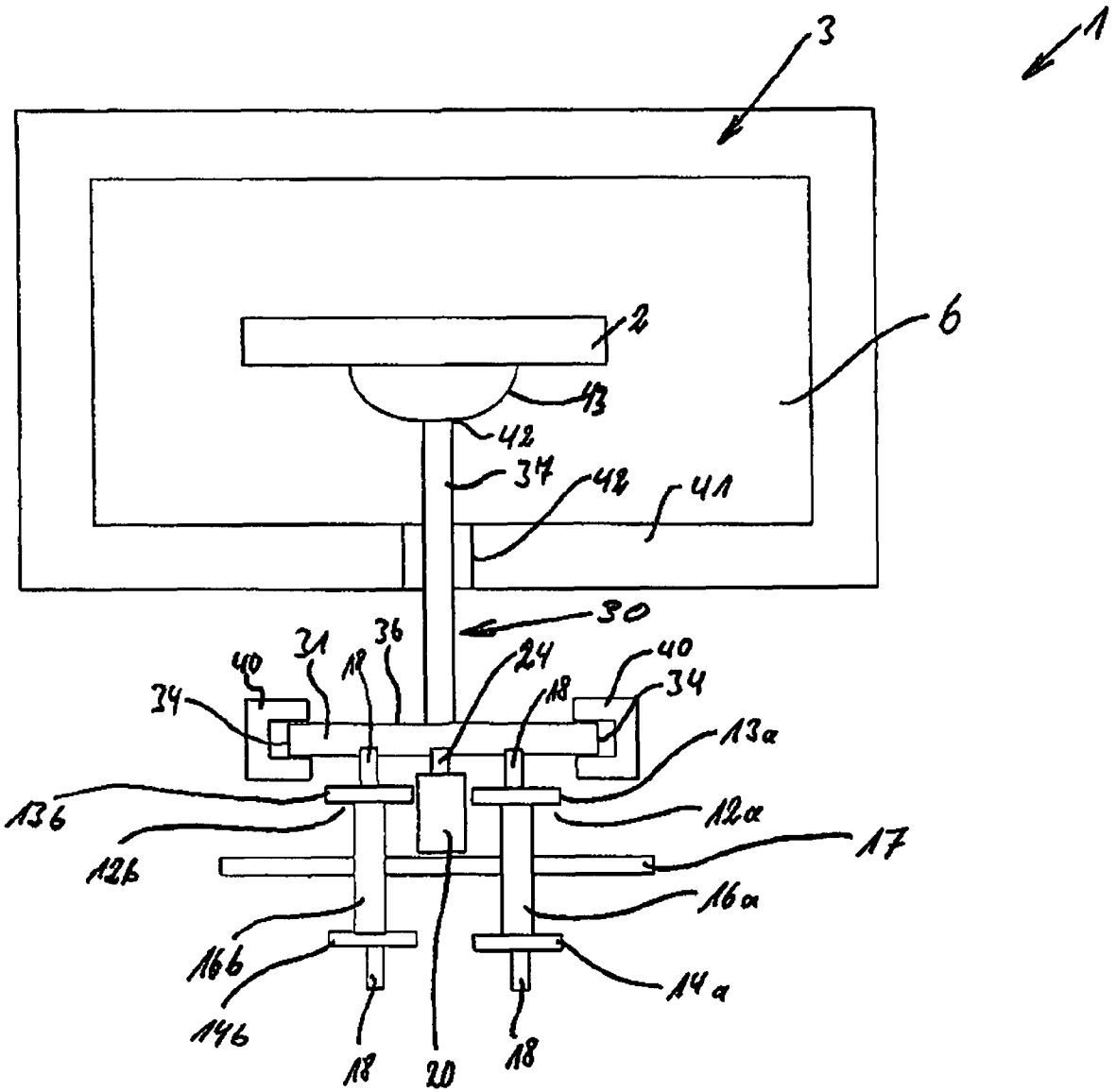
FIG. 3, the device in accordance with the invention, greatly schematized, in a transfer area between a first transport device and a second transport device.
Figure 4:
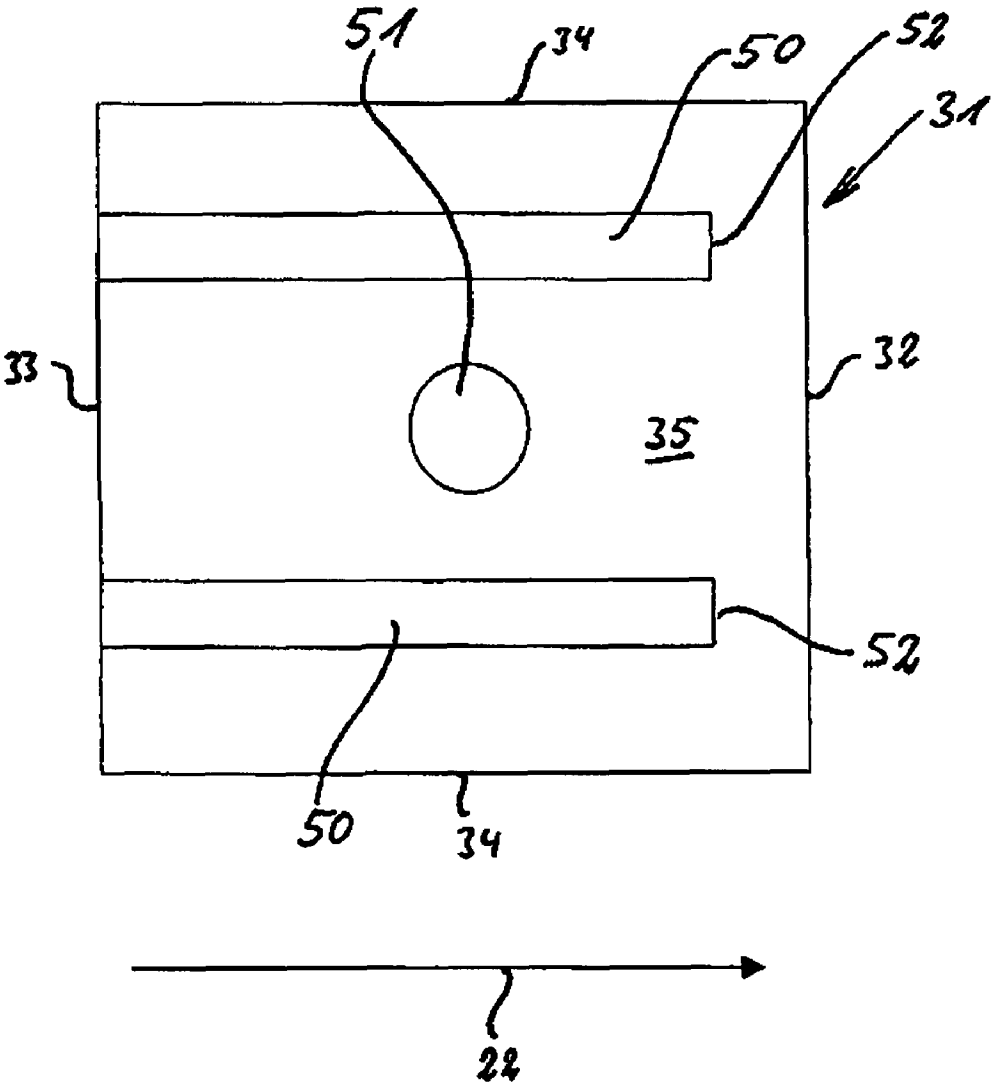
FIG. 4, a component carrier in accordance with the invention in a view from below.

The transport device 4 is arranged underneath the actual furnace 3. The transport device 4 comprises, at least underneath the furnace 3 and underneath the heating area 6, a belt or chain transport arrangement 12 as the first transport arrangement. The belt or chain transport arrangement 12 has at least one chain 12*a* or one belt 12*b*, having an upper stringer 13 and a lower stringer 14, wherein the upper stringer 13 and the lower stringer 14 are conducted around appropriate belt pulleys, or toothed or chain wheels 15, 16. The belt or chain transport arrangement 12 has in particular two parallel chains or belts 12*a*, 12*b*, which are arranged parallel in relation to each other, wherein respectively one lower stringer and upper stringer 13*a*, 13*b*, 14*a*, 14*b* is provided for the transport devices 12*a*, 12*b*. The corresponding toothed wheels and/or belt pulleys 15*a*, 15*b*, 16*a*, 16*b*, are preferably coupled, fixed against relative rotation, on a common driveshaft 17 (FIG. 3). The upper stringers 13*a*, 13*b*, or the chains or belts 12*a*, 12*b* themselves, have transport cams, transport protrusions or transport spikes 18, oriented outward, i.e. away from the wheels 15, 16. These transport cams, spikes or protrusions protrude outward from the chains 12*a*, or belts 12*b*, and are used as engagement means 18.

Furthermore, at least one linear transport arrangement 20 is provided as a second transport arrangement. The linear transport arrangement 20 is a linear drive mechanism, which can be moved hydraulically, pneumatically, electromagnetically, or by means of spindle drives. The movement direction (arrow 21) of the linear drive mechanism 20 here extends parallel in respect to the forward movement direction 22 of the transport device 4, while during operations the transport device 4 runs in only one direction, the direction of movement of the linear drive mechanism 20, or of the linear drive arrangement 20 is reversible.

The linear drive arrangement 20 has a cam or spike 24, which protrudes, or is movable, in the same direction as the cam 18, and is arranged so that it can be extended from and retracted into the linear transport arrangement 20. The linear drive arrangement 20 can be moved above the shaft 17 and between the two chains 12*a*, 12*b*, or belts 12*a*, 12*b*, or the belt pulleys 16*a*, 16*b*.

A second, identically embodied linear drive arrangement 25 can moreover be provided as third transport arrangement, located opposite the first linear drive arrangement 20. In this case the linear drive arrangement 20 is preferably located underneath the furnace outlet area 7, and the linear drive arrangement 25 underneath the furnace inlet area 5. The linear drive arrangements 20, 25 are preferably driven by servo motors.

Carrier elements 30 are provided for conducting the components to be hardened through the furnace 3. The carrier elements 30 have a flat, plate-like foot 31, which has a front edge 32 in the movement direction, a rear edge 33, as well as right and left lateral edges. The foot moreover has an underside 35 and an upper side 36. A support column 37 is provided, centered on the upper side 36 of the foot 31. The support column 37 extends away from the foot 31.

The foot 31 is guided by means of the lateral edges and encloses them, in guide rails 40, which extend from the furnace inlet as far as the furnace outlet. Here, the guide rails 40 extend above the transport arrangements 4, 20, 25, and underneath a furnace base 41, and guide the foot 31 in the vertical direction, as well as in a horizontal transverse direction in relation to the movement direction 22. The support element can have support rollers on its lateral edges 34, which are rotatably seated around a shaft extending parallel in relation to the plate level and are conducted to roll off in the guide rails. Moreover, guide rollers or guide balls can be provided, which are seated, rotatable around a shaft which is perpendicular to the plate level, and which provide a guidance transversely in respect to the conveying direction.

A slit 42 is provided in the furnace base 41, which is embodied to be continuous from the furnace inlet to the furnace outlet. The support column 37 is conducted through the slit 42 and protrudes some distance into the furnace area 6. A holding arrangement 43 for the workpiece 2, or components 2 to be heated, is provided at a free end of the support column 37. The slit is designed to be as narrow as possible, but is spaced apart from the support column 37.

The support element 30 is designed for transport through the arrangements 4, 20, 25 in the direction of the furnace passage direction 22. For this purpose, the foot 31 has engagement means 50 on its underside 35 for working together with corresponding engagement means of the chain(s) 12*a*, or belt(s) 12*b* of the transport device 4. In addition, the foot has engagement means 51 on its underside, which work together with the engagement means of the linear drive arrangements 20, 25.

If the engagement means of the transport device 4 are cams, spikes or protrusions 18 projecting away from the chains, the engagement means 50 are designed as parallel grooves, whose spacing corresponds to the spacing of the cams 18 of the transport device 4, which run parallel along in the forward movement direction 22. The grooves 50 are open on a rear front side 33 of the foot 31 and respectively terminate, adjoining the front edge 32, with a groove bottom 52.

If the engagement means of the transport devices are a protruding, extendible cam or protrusion 18, the corresponding engagement means part in the bottom 15 of the foot 31 is a corresponding positive recess 51.

Figure 5:
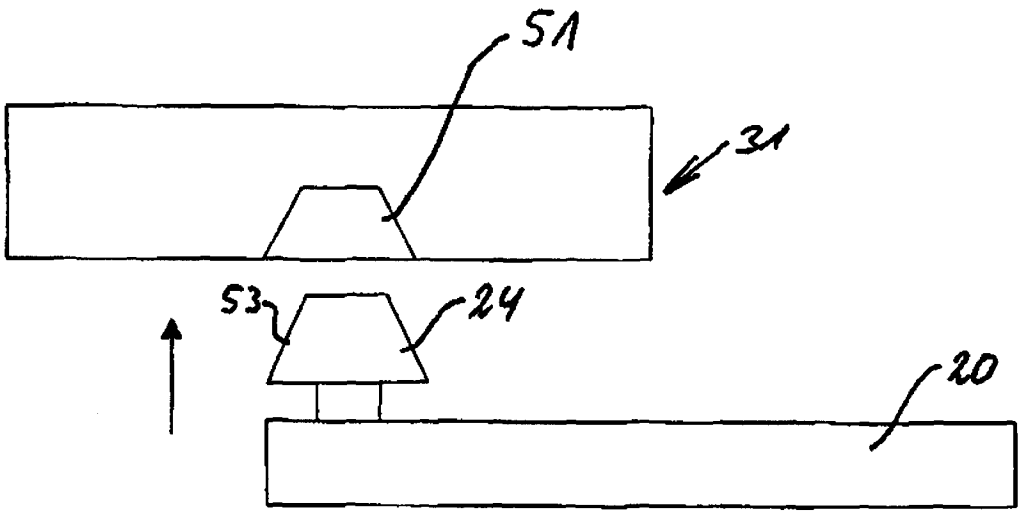
FIG. 5, a longitudinal section through a component carrier in the area of an engagement means with a corresponding engagement means of a linear drive mechanism.
Figure 6:
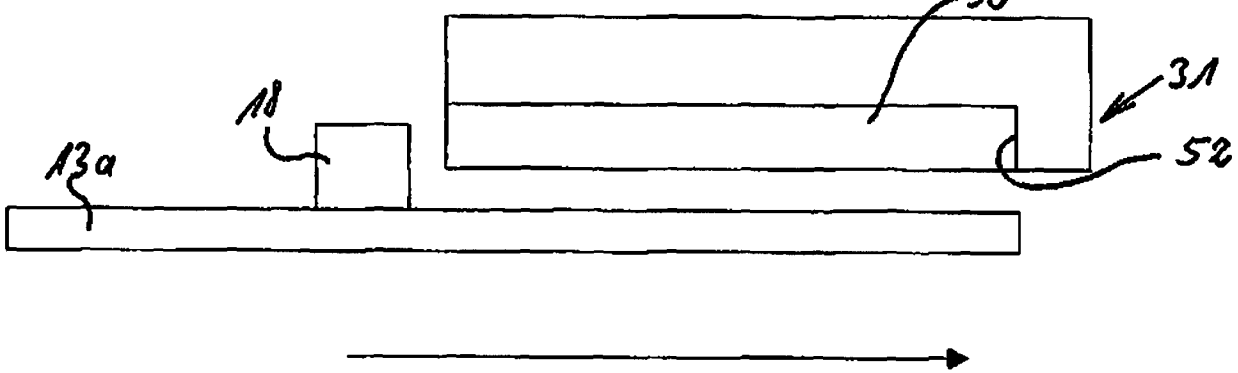
FIG. 6, the carrier in accordance with FIG. 5 in a further partly sectional view, showing an engagement means for a corresponding engagement means of a chain or belt drive.

To obtain exact and accurate positioning, it is preferred (FIG. 5) that the recess 51 is for example embodied cone-like, or in the shape of a truncated cone, and the corresponding cam 24 of the linear drive arrangement 20, 25 has a corresponding form such that, following its extension, it fits in a positive manner into the recess 51, and that it not only provides a positive connection by means of its corresponding wall 53 in the form of truncated cones, but that positioning takes place.

In what follows, the mode of operation of the device in accordance with the invention, or the method in accordance with the invention, will be explained.

In front of the furnace inlet 5, the carriers 30 are set with their feet 31 into the rails 40. A carrier element 43 for a component 2 is mounted on a free end 42 of the support column 37—provided it had not already been equipped with one. The component 2 is subsequently placed on it in an exact position. If the component 2 is an already preformed component 2, the carrier element 43 can be embodied in such a way that it engages defined portions of the contour of the component 2, or engages it with appropriate pins, for example through already prepared holes.

Thereafter the linear drive mechanism 25 moves the cam 23 underneath the opening 51 of the foot 31 of the carrier 30. The cam 24 is moved into the cutout, or the engagement means 51, hydraulically, pneumatically or electromagnetically. Subsequently the linear drive mechanism 25 moves the carrier 30 with the component 2 through a possibly provided first furnace gate 10, the furnace inlet zone 5, and possibly a second gate, which separates the inlet zone 5 from the heating zone 6.

The driving movement is terminated when the cam 24 of the linear drive mechanism 25 is located in the area of the chain wheels 16*a*, 16*b*, or pulleys 16*a*, 16*b*, and above a shaft 17. The cam 24 of the linear drive mechanism 25 is now lowered, so that the linear drive can move out of this area back again in front of the furnace. Here it conveys the next carrier 30 in the same way. By means of providing grooves it is also possible to use carriers which are longer than the linear spacing between adjoining cams 18.

The carrier 30, which is located in the area of the wheels 15*a*, 15*b*, is now moved on in that cams 18 on the exterior circumference of the transport arrangement 4, or of the respective upper stringer 13 of the chain or belt, obeying the rotation of the wheels 15, 16, move up on the wheel 15 and enter the grooves 50 from behind. At the moment when the cams 18 contact the groove walls, or the groove bottom 52, the carrier is transported by the chain through the heating zone 6. By means of the provision of grooves which are longer than the linear spacing between adjoining cams 18 it is also possible to employ carrier elements 30, which are longer than the linear spacing of the cams.

The movement cycles of the linear drive mechanism and the chain and belt drive mechanisms are preferably synchronized. This means that the first linear drive mechanism conveys at high speed, is gently slowed down in the area of the transfer, and then conveys in such a way that the cams of the chain or belt drive are engaged without shock and continue to convey. Thus, the linear drive mechanism runs along for a short distance at the chain speed until the engagement is released. In accordance with the method, at the transfer point the linear drive mechanism moves along with the chain, engages the carrier and then increases the movement speed, while the cams of the chain drive are moved down.

The linear drive mechanism 20 already waits for the carrier 30 at the end of the heating zone 6, wherein the cam 24 of the linear drive mechanism 20 enters the opening 51 at the moment at which the carrier is located above it. This preferably also takes place at the reversing point of the respective chain 12*a* or of the belt 12*b*, so that the cams move out of the grooves 50, while the cam 24 moves into the opening 51 in the carrier 30. Now the linear drive mechanism 20 can pull the carrier 30 out of the heating area, or heating zone 6, through the gate 9, through the outlet zone 7 and through the second gate 11 in a positionally exact manner to the outside.

Here, the conveying speeds of the linear drive mechanisms 20, 25 can be considerably higher than the conveying speed of the transport device 4. Transport speeds of 10 m/sec., in particular, are possible.

The lock doors 8, 9 and the gates 10, 11 are preferably triggered in such a way that the movement of the linear drive mechanism causes an opening of a gate at the appropriate time and that the gates close immediately, following the passage of the carrier. A cost-effective, energy-saving type of operation of the furnace is possible by means of this.

Different from the above described preferred embodiment, conveyance by means of the transport device 4 can already start in the furnace inlet area 5 and terminate in the furnace outlet area 7, in which case either gates are provided then between the furnace inlet area 5 and the heating zone 6 and the furnace outlet zone 7, which can be appropriately triggered for opening and closing when the components are passing through, or no gates at all are provided, but instead only locks, which are provided by appropriate hot or cold air curtains, or air suction devices.

After the carrier 30 with the component 2 has been completely pulled out of the furnace, the component is removed and further processed. The carrier is also removed from the rails and is returned to the furnace inlet via suitable return arrangements, and is inserted again into the rail there.

It is of advantage in connection with the device in accordance with the invention and the method in accordance with the invention that the carrier element, or the component carrier 30, is conducted outside of the furnace for the greatest portion. In this way only small portions of the component carrier are heated, and in this way an energy loss because of the component carrier cooling off outside of the furnace is minimized.

Because the entire transport device is located outside of the furnace, it is possible to approach the transport device in case of damage, maintenance, or the like, and to repair the damage or perform maintenance without the furnace having to be turned off. This also increases the efficiency and reduces the energy consumption.

The respective engagement means of the transport arrangements 4, 20, 21, or of the carriers 30, need not be cams or spikes, any type of shapes which correspond with each other and can result in a forward feed, are suitable. Moreover, the engagement means need not be arranged in the bottom of the carrier. The cams, or other means of the transport arrangements 4, 20, 25 can in the same way also engage the front or rear transverse edges of the carrier.

In connection with the invention it is furthermore of advantage that, in case components fall off the receiver and rest on the furnace bottom, a special carrier with a clean-up shield which moves over the bottom, can be employed and conveys this component out of the furnace.

The invention claimed is:

1. A device for heating steel components, comprising:

a furnace for heating the steel components; and at least one transport device for conducting the components through the furnace;

wherein the at least one transport device comprises at least one transport arrangement, which is arranged in or at a heating area of the furnace and is embodied for transporting the components in the course of being heated; and a second transport arrangement that adjoins the first transport arrangement and extends over the length of the furnace in the transport direction, so that components can be conveyed out of the furnace using the second transport arrangement;

wherein the transport device is arranged outside of the furnace and has engagement means for engagement with corresponding engagement means on at least one carrier element, which is transported by the transport device outside of the furnace and is fixed in its position and placement, wherein partial elements of the carrier element pass through a furnace wall, and there is an arrangement in the furnace interior for holding the components; and in one furnace wall, through which a partial area of the carrier passes, a linear slit in the transport direction, through which a partial area of the carrier extends.

2. The device in accordance with claim 1, further comprising a third transport arrangement, which extends from an area upstream in the transport direction of the furnace as far as the first transport arrangement in such a way that the third transport arrangement can convey the components into the furnace.

3. The device in accordance with claim 2, wherein the at least one carrier element for the components that are to be heated in the furnace has a first area, which is guided, vertically and in a horizontal transverse direction with respect to the conveying direction, from a furnace inlet a the furnace outlet in a guide arrangement, and wherein the carrier element further comprises engagement means for corresponding engagement with the second and third transport arrangements.

4. The device in accordance with claim 1, further comprising a sealing arrangement that seals the slit in the furnace wall toward the exterior, so that no air enters into the furnace from the exterior, and heat losses due to radiation and/or convection toward the exterior are avoided.

5. The device in accordance with claim 4, wherein the sealing arrangement comprises plastic sealing lips extending linearly along the slit and from the slit edges into the slit, wherein the sealing lips contain at least one of the group consisting of metal, ceramic material, glass, and plastic fibers, and the sealing lips are tightly arranged and extend into the slit.

6. The device in accordance with claim 4, further comprising metal lamellas, which are spring-loaded parallel with respect to a furnace wall surface, into which the slit has been cut, and can be pivoted vertically with respect to the slit over the slit, so that a carrier running through the slit pivots the sealing arrangement out of the area of the slit and, following the passage of the carrier, the sealing arrangement again springs, or moves, back into the slit.

7. A furnace for the device in accordance with claim 1, wherein the furnace comprises a slit continuously extending from a furnace inlet to a furnace outlet in at least one wall in order to move components to be heated through the furnace using a carrier that is moved outside of the furnace and extends through the slit.

* * * * *